US005839731A

United States Patent [19]

Feola

[11] Patent Number: 5,839,731

[45] Date of Patent: Nov. 24, 1998

[54] METHOD AND APPARATUS FOR PLAYING A CASINO GAME

[75] Inventor: John Feola, Medford, Mass.

[73] Assignee: New Vision Gaming and Development, Inc., Medford, Mass.

[21] Appl. No.: 819,606

[22] Filed: Mar. 17, 1997

Related U.S. Application Data

[60] Provisional application No. 60/022,034, Jul. 22, 1996.

Related U.S. Application Data

[63] Continuation-in-part of Ser. No. 720,560, Sep. 30, 1996, Pat. No. 5,664,781.

[51] Int. Cl.[6] ..... A63F 1/00

[52] U.S. Cl. ..... 273/292; 463/13

[58] Field of Search ..... 273/292, 303, 273/309, 274; 463/1, 7, 11, 12, 13, 26, 27, 25

[56] References Cited

U.S. PATENT DOCUMENTS

| | | | |
|---|---|---|---|
| 1,527,929 | 2/1925 | Simons | 273/274 X |
| 4,948,134 | 8/1990 | Suttle et al. | 273/85 CP |
| 5,257,789 | 11/1993 | LeVasseur | 273/309 |
| 5,257,810 | 11/1993 | Schorr et al. | 273/292 |
| 5,265,882 | 11/1993 | Malek | 273/292 |
| 5,382,025 | 1/1995 | Sklansky et al. | 273/292 |
| 5,390,934 | 2/1995 | Grassa | 273/292 |
| 5,395,120 | 3/1995 | Malek | 273/292 |
| 5,486,005 | 1/1996 | Neal | 273/292 |
| 5,494,296 | 2/1996 | Grassa | 273/292 |
| 5,531,440 | 7/1996 | Dabrowski et al. | 463/12 |

*Primary Examiner*—William E. Stoll
*Attorney, Agent, or Firm*—Morse & Altman

[57] ABSTRACT

A casino game based on a selected card game in which a player wagers on one or more of a group of hands, and where the chances of winning are not enhanced by the skills of the player and no discretion in the selection of cards is vested in either the player or dealer. A card game, such as blackjack, baccarat, or stud poker, is selected. A number of hands are dealt as lines on a playing surface and players wager as to which hand will win. The playing surface has a dealer position including a line for each hand dealt, and player positions in a semicircle around the dealer position, each including a location at which wagers are placed. Winning wagers are paid a multiple of the wager. Optionally, the multiple is based on the odds of obtaining the particular winning combination.

18 Claims, 3 Drawing Sheets

METHOD AND APPARATUS FOR PLAYING A CASINO GAME

RELATED APPLICATIONS

The present application is a continuation-in-part application of application Ser. No. 08/720,560, dated Sep. 30, 1996 for METHOD AND APPARATUS FOR PLAYING A POKER-TYPE CARD GAME in the name of John Feola now U.S. Pat. No. 5,664,781.

BACKGROUND OF THE INVENTION

The applicant wishes to claim the benefit under 35 U.S.C. §119(e) of provisional patent application Ser. No. 60/022,034, dated Jul. 22, 1996 for METHOD AND APPARATUS FOR PLAYING A POKER TYPE CARD GAME in the name of John Feola.

1 . Field of the Invention

The present invention relates to casino games, more specifically, to a casino game based on a card game in which necessary knowledge of the card game in minimized and skill is not a factor in wagering.

2. The Prior Art

When a person enters a casino for the first time, she encounters a wide array of games upon which to wager, including such card games as poker, baccarat, and blackjack. This newcomer also sees people who are intimately familiar with the environment and with the games of gambling. While watching these people, the newcomer may feel overwhelmed and intimidated. This intimidation can take the form of feelings of embarrassment at not knowing how to play the games or not being able to play as fast or well as others, and can manifest itself by not trying new games or even in not gambling at all.

Of the many card games used for gambling, blackjack, poker, and baccarat are the most popular. Blackjack and baccarat are popular because the rules are simple and the game is fast. However simple the game is, choices still need to be made by the player during the course of the game and for the player that is unsure of herself, this can be a cause of anxiety and intimidation, especially when playing along side people who are experienced in the game. And the rules of poker are much more complicated than blackjack and baccarat, which can lead to even greater levels of intimidation.

The rules of casino blackjack and baccarat are such that no discretion in how the game is played is vested in the dealer, an employee of the gaming establishment. In the typical game of blackjack, the dealer each receives a card face up and a card face down, and the player receives either two cards face down or a card face up and a card face down. The player may then choose to take additional cards, attempting to have the numerical total of the cards come as close as possible to 21 without going over. On the other hand, the dealer has no such choice: if the total of the cards is less than 16, the dealer must take another card and if the total is 16 or greater, the dealer is not allowed another card. The rules allowing the dealer to take an additional card are similar in baccarat.

The many varieties of poker fall into two main categories, draw poker and stud poker. In draw poker, each player is allowed to exchange some of the initial cards for others, whereas in stud poker, no exchange is allowed. In the typical stud poker game, each player initially wagers a nominal amount, generally called the ante or vigorish, to signify that she is playing the hand. After at least one card is dealt to each player, either face up, so that all players can see the card, or face down, so that only the player of the hand can see the card, as previously determined, a round of wagering occurs. The process of dealing cards to each player followed by a round of wagering continues until each player has the proper number of cards for the form of stud poker being played. After the last round of wagering, the winner is determined. When playing 5-card stud, the highest ranked poker hand using all five cards is the winner. When playing 7-card stud, the highest ranked poker hand using the best five of the seven cards is the winner. The ranking of poker hands, from best to worst, is as follows: royal flush, straight flush, four of a kind, full house, flush, straight, three of a kind, two pair, one pair, and highest cards.

Although many people know how to play poker and enjoy playing it, it is rarely used in casino gambling. The reason is that poker includes rounds of wagering, where the amount wagered changes depending upon what each player thinks her chances of winning are at any particular moment during the game. This type of gambling is not conducive to the casino environment, where it is desired that minimal or no discretion be vested in dealers.

Because of the amount of discretion necessary, players typically play against each other rather than against the "house", the gambling establishment. The house typically provides facilities to the players including a dealer, the playing cards, and table. In order to compensate the house and to profit from the game, the house collects a nominal percentage of each player's wager (a portion of the "pot"), a fixed amount for each game, or a fixed amount for increments of time, such as an hour. Generally, this amount is less than the amount that would be made if the house was involved as a player in the game.

Many players do not like to play poker in this setting. They prefer to play against the house rather than against fellow players.

One solution is the electronic poker games that have become increasingly popular. The player wagers against the house, not other players, and the house keeps any winnings. Typically, wagers are made in fixed amounts by the player, so there is no need for the machine to make decisions. However, many players like the interaction with other players, dealers, and real playing cards that comes with the normal game of poker. For these people, the game itself is a social event that cannot be duplicated by electronic means.

SUMMARY OF THE INVENTION

It is an object of the present invention to provide a game that is suitable for use in casino gambling.

Another object of the present invention to provide a game suitable for use in casino gambling based on a card game where the player can feel comfortable learning the card game.

Yet another object of the present invention to provide a game suitable for use in casino gambling based on a card game where only minimal knowledge of the rules of the card game is necessary to play the game.

A further object of the present invention to provide a game suitable for use in casino gambling based on a card game where knowledge of the rules of the card game can be learned by the player as games are played.

Accordingly, the present invention provides a game, the essence of which is that a player wagers on one or more of a group of hands that she hopes will win, and the chances of winning are not enhanced by the skills of the player. In addition, the basic game is played with the house as the bank, rather than against the other players.

Before game play begins, the house selects the rules of the game to be played which includes selecting the basic card game. The card game is chosen from a list of typical casino card games, such as blackjack, baccarat, and stud poker, and additional rules for the chosen card game are also selected. These particular card games are included because, as played in casinos, they give the dealer no discretion in choosing cards.

Typically, one 52-card deck of playing cards is used. There may be from two hands to the maximum number of hands that can be made from 52 cards for the selected game. If only two hands are played, a vigorish may be required in addition to the wagers. Optionally, the game is played with more than one deck.

Blackjack and baccarat hands start with two cards and stud poker typically has five or seven cards in each hand. However, many kinds of stud-poker-type games can be used with the present invention. A hand may have anywhere from one card ("high-card") to as many as desired, limited only by the number of decks used. And the number of cards used to determine the best-ranked hand may be any subset of cards in the hand or all of the cards in the hand. Optionally, the player is allowed to select which subset of cards to wager on, independent of other players. Optionally, the lowest-ranked hand is chosen to win or the player is given the option of choosing the highest- or lowest-ranked hand to win, but not both in the same game.

The selected game is played on a playing surface that has a dealer position with a location or set of locations for each hand to be dealt. The set of locations may be oriented vertically or horizontally. Each hand has an identifier, typically a numeral. Optionally, the playing surface includes a rack for holding gambling tokens, such as chips. Optionally, there is an indicator on the playing surface for indicating which hand or hands currently have the winning combinations.

Preferably, each player position includes a identifier corresponding to each dealt hand. Optionally, if a vigorish is required, each player position includes a separate vigorish symbol. Typically, there are six player positions, but the number of player positions may vary.

The game begins by each player choosing the hand or hands that she thinks will have the winning combination of cards by placing a wager in the corresponding identifier symbol of the player position. Optionally, the player may select more than one hand and the order in which the hands will finish.

Next, the dealer deals out the selected number of hands to the dealer position. If playing poker, the cards are dealt a round at a time, a dealt round being at least one card to each hand. Optionally, players may increase their wagers after each dealt round. If the game is blackjack or baccarat, each hand is dealt two cards. Optionally, players may increase their wagers after the initial deal. Then additional cards are added to each hand based on the rules being played.

After the last round is dealt and the wagering is complete, the winning hand is determined using the selected rankings. Each player choosing the winning hand receives an amount that is typically a multiple of that player's wager. All losing wagers are collected by the dealer for the house. Optionally, the multiple is based on the rank of the hand or the odds of obtaining such a combination of cards.

There are a number of other optional enhancements which may be combined as desired. Optionally, one of the players, rather than the casino, is the bank. Optionally, rather than being played on a table surface with a live dealer, the game is played on a video machine, a personal computer, a slot machine, over an on-line computer network, or on another type of one-way or interactive gaming or entertainment equipment. Optionally, a match jackpot and/or a tough beat jackpot may be played as an adjunct to the regular game. The match jackpot is won when there are at least two hands having the same highest ranking. The tough beat jackpot is won when a ranked hand is beaten by a hand with a higher ranking.

Other objects of the present invention will become apparent in light of the following drawings and description of the invention.

BRIEF DESCRIPTION OF THE DRAWINGS

For a fuller understanding of the nature and object of the present invention, reference is made to the accompanying drawings, wherein.

DETAILED DESCRIPTION

Figure 1:
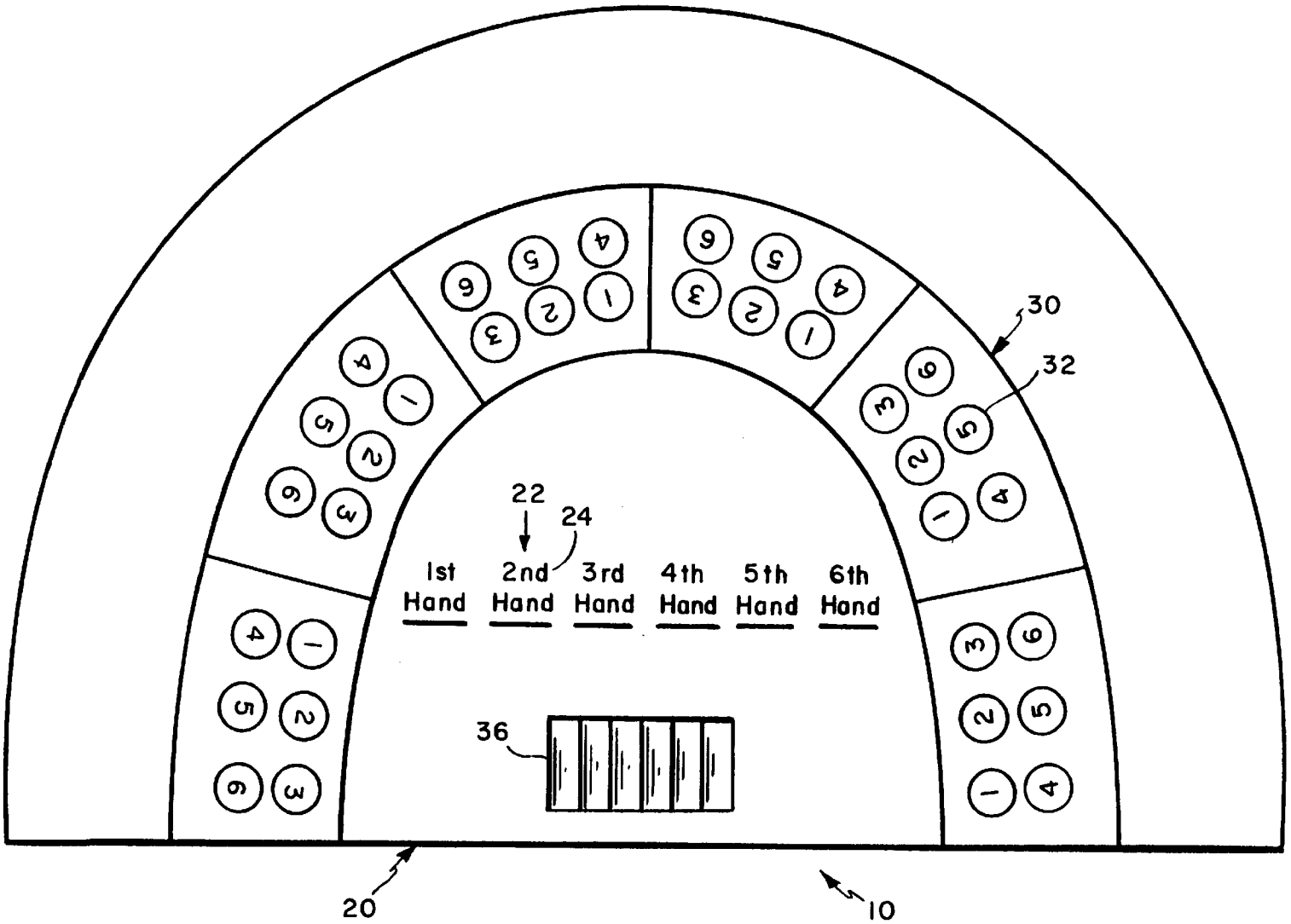
FIG. 1 shows a playing surface for a six-hand embodiment with vertical lines of the present invention.

The card game of the present invention provides a game based on a card game where only minimal knowledge of the rules of the card game are necessary to play. The game is played with a set of basic rules and includes a number of optional enhancements. The essence of the game is that a player wagers on one or more of a group of hands that she hopes will win, and the chances of winning are not enhanced by the skills of the player. The dealer handles all hands and the player has no say in the contents of each hand or how each hand is played. The contents of each hand and how each hand is played is purely random based on the order of the playing cards in the deck. To further randomize the result, the game is based on card games in which no discretion is vested in the house. Thus, the chances of choosing the winning hand among two hands is 50%, among three hands, 33.3%, among four hands, 25%, etc.

The basic game is played with the house as the bank, rather than against the other players. This means that it is irrelevant to each player how the other players are playing the game, for example, which hands they are wagering on and how much they are wagering.

Before Game Play

Before game play begins, the house selects the rules of the game to be played, which includes such items as the basic card game, how many hands are dealt, and how the winning hand is determined, and which cards are dealt face up and face down. The cards dealt face up are visible to all the players and the cards dealt face down are not visible until after the wagering is complete and the winners are being determined.

The card game is selected from a list of typical casino card games, such as blackjack, baccarat, and stud poker. Stud poker, rather than draw poker, is a selection for the same reason. Additional rules that must be selected for stud poker include how many cards are in each hand, how many of those cards are used to determine the winning hand, and the ranking order used to determine the winning hand.

Blackjack and baccarat are selections because the games, as played in casinos, give the dealer no discretion in choosing cards. When played in conjunction with the present invention, all player discretion is removed because the players do not have hands of their own, all hands are played by the dealer. Additional rules that must be selected for blackjack and baccarat include the card total at which the hand cannot take another card.

Typically, one standard 52-card deck of playing cards is used. The number of hands dealt is not related in any way to the number of players, so it does not matter how many players there are in the game. There may be from two hands to the maximum number of hands that can be made from a standard 52-card deck of cards for the selected game. For example, when baccarat is played, the maximum number of hands is 17 (17 hands times a maximum of three cards per hand is 51 cards, leaving at least one card unused). When 7-card stud is played, the maximum number of hands is seven (seven hands times seven cards per hand is 49 cards, leaving three cards unused). Optionally, the game can be played with more than one 52-card deck. By increasing the number of decks, the number of hands that can be played in one game also increases by a proportionate amount.

As stated above, the game can be played with only two hands. However, when two hands are played, the odds of winning are approximately even, as opposed to the odds being less than even when more than two hands are played. Because the establishment has no advantage, there is no incentive that the gambling establishment to provide a two-handed game. Therefore, each player may be required to place an ante or vigorish in addition to the wagers.

Blackjack and baccarat are played by initially dealing two cards to each hand and, typically, stud poker is played by dealing five or seven cards to each hand, as in 5-card or 7-card stud. However, many kinds of stud-poker-type games can be used with the present invention, the commonality between the games being that the winning hand is determined using poker rankings. For example, the game can be as simple as one where each hand has only one card ("high-card"). Or the game may be a shortened version of poker where each hand has three cards. Or the game may be more complex than a standard poker game, where each hand has more then five cards and the best five cards from each hand are used to determine the best-ranked hand. 7-card stud is an example of the latter, however, a game may be chosen that uses more than seven cards. Finally, each hand may have more than five cards, where any subset of the cards may be used to determine the best-ranked hand.

Preferably, when the basic card game is blackjack, the rules of standard blackjack are used to determine the winning hand. That is, the hand have a total closest to 21 within being greater than 21 wins. Preferably, when the basic card game is baccarat, the rules of standard baccarat are used to determine the winning hand. That is, the hand have a total closest to 9 wins.

Preferably, when the basic card game is poker, the rules of standard poker apply to determine the winning hands. The standard ranked poker hands, from best to worst, are a royal flush, straight flush, four of a kind, full house, flush, straight, three of a kind, two pair, one pair, and highest cards. This is the normal order used to rank hands. However, the present invention contemplates that any ranking order may be selected. Additionally, if more than five cards are used to determine the best-ranked hand, more and different combinations are included in the ranking. For example, if six cards are used to determine the best-ranked hand, a hand may include two sets of three of a kind, which is not a standard ranked hand. Optionally, "wild cards" may be used in determining the ranking. The cards that act as wild cards are selected before the game begins. "Jokers" may be included in the deck as wild cards.

Optionally, when the basic card game is poker, rather than the players choosing the hand with the highest ranking, the players choose the hand with the lowest ranking. An alternative to this option is that each player is free to choose whether she is wagering on the hand with the highest or lowest ranking. However, only one choice is allowed for each player in each game.

Optionally, when the basic card game is poker, the present invention contemplates allowing each player to independently select a subset of cards within the hands of the selected game to wager on. For example, suppose the house selects 5-card stud as the game to be played. The first player may choose to wager on all five cards dealt to each hand. She will then win or lose based on the best hand using all five cards. Another player may choose to wager on only the first three cards dealt to each hand. He will then win or lose based on the best hand using only the first three cards dealt to each hand. Any possible combinations of subsets of cards within the hands is contemplated by the present invention.

The Playing Surface

Figure 2:
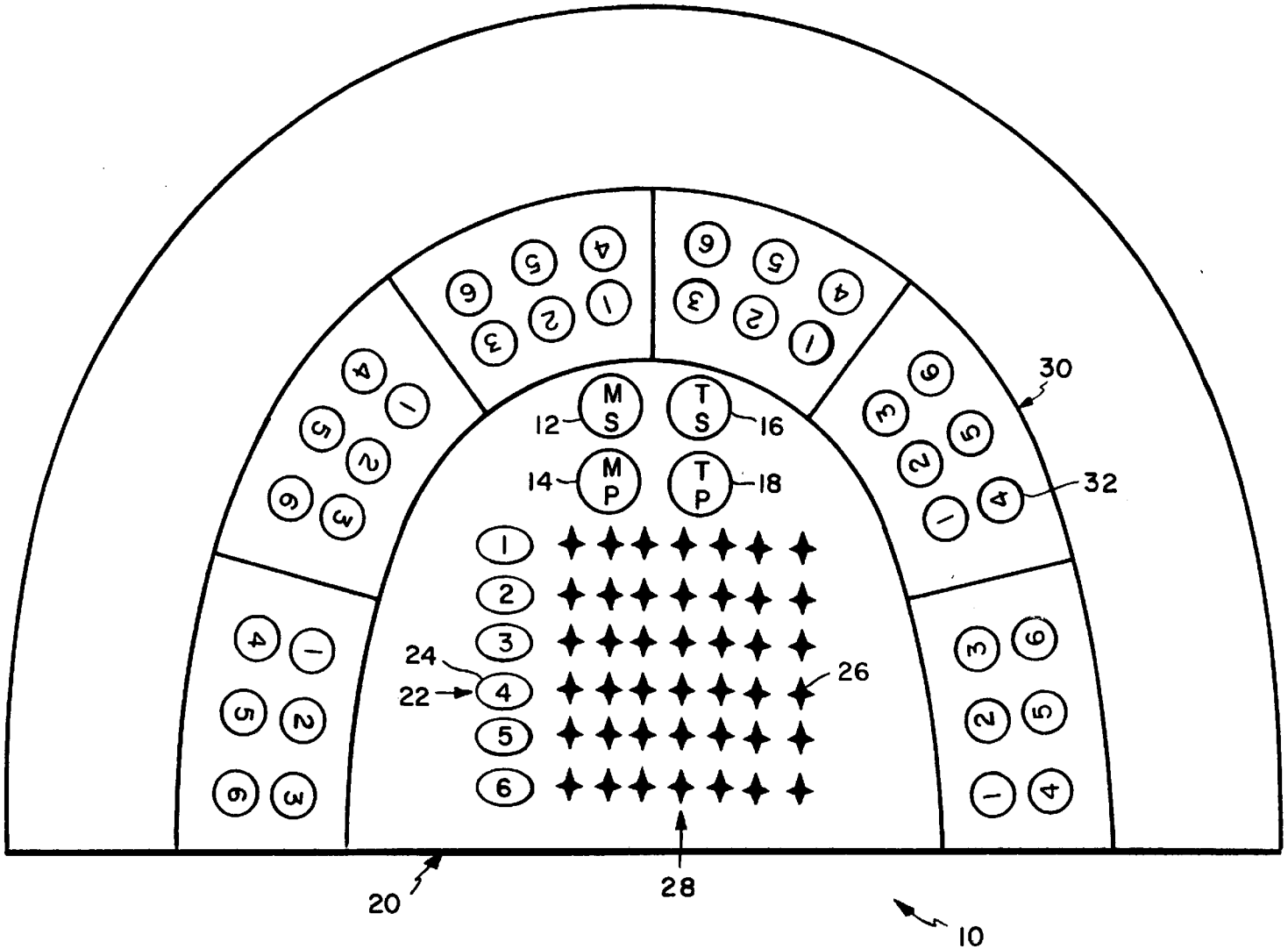
FIG. 2 shows a playing surface for a 5-card, six-hand game embodiment with horizontal lines and optional enhancements.
Figure 3:
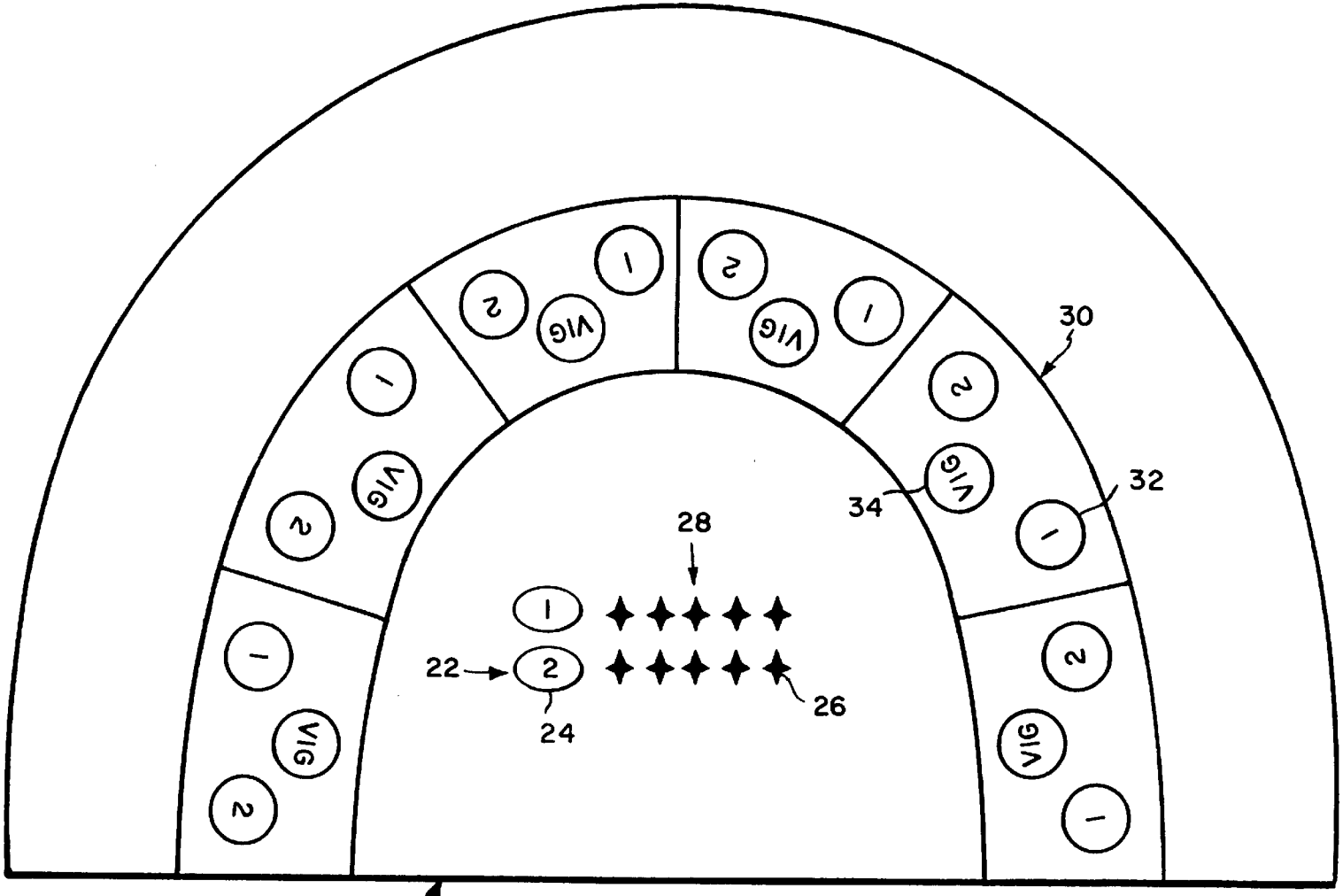
FIG. 3 shows a playing surface for a 5-card, two-hand game embodiment with horizontal lines.

The game is played on a playing surface, typically a table top. Examples of several different surface layouts are shown in FIGS. 1–3. There are several aspects to the layouts that are common to all forms of the game. The dealer position 20 has a plurality of parallel lines 22, one for each hand to be dealt. The lines 22 may be vertical columns, as in FIG. 1, or horizontal rows, as in FIGS. 2 and 3. The symbol 24 at the end of the line 22 is the hand identifier, which are typically numerals running sequentially starting with "1". Optionally, there are symbols 26 in the line 22 indicating where each card of the hand is placed as it is dealt, and indicating the maximum number of cards dealt to each hand. For example, five card symbols 26 mean that the basic game uses a maximum of five cards per hand. When no card symbols 26 are present, the dealer announces the selected game, for example, verbally or by a sign located adjacent to the table.

Optionally, the playing surface 10 includes a rack 36 for holding gambling tokens, such as chips. The rack 36 is of a conventional design and is typically a plurality of parallel semicylindrical depressions in the playing surface 10.

Optionally, there is at least one indicator on the playing surface that indicates which hand or hands currently have winning combinations of cards. The indicators are moved by the dealer as necessary as the game progresses.

Preferably, the player positions 30 are evenly spaced about a semicircle around the dealer position 20. Each player position 30 includes a symbol 32 containing an identifier corresponding to each line 22 that will be dealt a hand. Typically, there are six player positions 30, but the number of player positions 30 may vary. Optionally, if a vigorish is required, it is placed on a separate vigorish symbol 34 in the player position 30, as shown in FIG. 3.

Playing the Game

To begin the game, each player chooses the hand or hands that she thinks will have the winning combination of cards by wagering an amount on those hands. The selections are made by placing the amount to be wagered on the corresponding identifier symbol 32 of the player position 30. The wagered amount is indicated by any tokens that acceptably signify value, such as cash, chips, or credit vouchers.

Optionally, the player may select more than one hand and the winning order of those the hands. For example, the player may select one hand to have the winning, or best, hand and another hand to have the second-best hand. This is analogous to the perfecta or exacta in horse racing. In another example, the two best hands are selected, without regard to which of the two is the winning hand, which is analogous to the quiniella in horse racing. Other combinations are contemplated, for example, the trifecta, where the three best hands are selected in order, and the box, where the three best hands are selected without regard to which is the winning hand.

Next, the dealer deals out the selected number of hands and places them in the line 22 of the dealer position 20. If card symbols 26 are present, the cards are placed on these symbols 26. If the basic card game is poker, the cards are dealt a round at a time, a dealt round being at least one card to each hand. Optionally, players may increase their wagers after each dealt round. Wagers are increased by adding tokens to the appropriate identifier symbol 32 in the player position 30. A player may stop wagering on any hand after any dealt round. In a special case of the game, the only wagering that occurs is when the player selects the hand or hands that she thinks will win. No wagering occurs during the dealing of the cards.

If the game is blackjack or baccarat, each hand is initially dealt two cards. Optionally, players may increase their wagers after the initial deal. Then additional cards are added to each hand based on the rules being played. For example, if the total of the face value of the cards is less than 16, another card is added to the hand.

After all cards are dealt and the wagering is complete, the winning hand is determined using the selected rules. The players choosing the winning hand receive a predetermined amount of winnings that is typically a multiple of the total amount that the player wagered on the winning hand. The winning multiple may be adjusted periodically by the house. Preferably, the winning multiple is adjusted based on the number of hands being played, because the chances of winning decrease as the number of hands increases. All losing wagers are collected by the dealer for the house.

Optionally, the winning multiple is based on the rank of the hand, where the multiple increases with the odds of that rank being dealt, because the chances of the winning hand having a particular rank decreases as the rank increases. For example, a "blackjack" (an ace with either a ten, jack, queen, or king) may pay more than a winning hand of 20. Or, in another example, a straight flush will pay a higher multiple than a full house, which, in turn, will pay a higher multiple than two pair. Preferably, no additional wager is required by the player to take advantage of increased winning multiples for greater-ranked hands, although it is contemplated that an additional wager may be required.

There are a number of other optional enhancements to the basic game. In one option, the game can be played where one of the players, rather than the gambling establishment, is the bank. The player may pay for the privilege of being the bank or the privilege may rotate among those players that wish to exercise the privilege. The establishment may require that the bank player pay a fee to the establishment for the privilege. To cover the costs to the establishment of furnishing the playing facilities, the establishment may collect a percentage of the wagers for each hand, a fixed amount for each game, or a fixed amount for increments of time, such as an hour.

Optionally, rather than being played on a table surface with a live dealer, the game is played on a video machine, a personal computer, a slot machine, over an on-line computer network, or on another type of one-way or interactive gaming or entertainment equipment.

Optionally, a match jackpot may be played as an adjunct to the normal game. This jackpot is won when there are at least two hands having the same winning combination. Prior to the beginning of play, the house determines how close two hands must be to qualify as having the same winning combination. For example, all straights may have the same rank or only straights with the same highest card may have the same rank.

Optionally, a tough beat jackpot may be played as an adjunct to the normal game. This jackpot is won when a ranked hand is beaten by another hand with a higher ranking. The house will determine which ranked hands are eligible for the tough beat jackpot prior to beginning game play.

If either the match jackpot or tough beat jackpot are offered, playing them is optional and one or both may be played by a player. Those players that do not choose to play either jackpot may still play the game. It is optional with the house whether or not to allow either jackpot to be played without also playing the game.

A jackpot may be "set" or "progressive". In a set jackpot, the amount put into the jackpot for each game is fixed, but the fixed amount may be adjusted periodically, for example, after the jackpot is won. In a progressive jackpot, the amount put into the jackpot increases for each game played during which the jackpot is not won. There may be a set jackpot, a progressive jackpot, or both for each of the match and tough beat jackpots. Intention to play a jackpot is indicated by placing a wager in one or more of special locations on or near the playing surface 10. For example, as in FIG. 2, there are separate locations on the playing surface 10 for the match set 12, match progressive 14, tough beat set 16, and tough beat progressive 18 jackpot wagers.

Only those players who wager a predetermined amount on a jackpot before a game are eligible to win that jackpot on the completion of that game. If more than one eligible player wins a set jackpot, each winner is paid a predetermined amount. If more than one eligible player wins a progressive jackpot, its value is divided equally among the winners.

Thus it has been shown and described a game which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A method of playing a card game with at least one standard deck of 52 playing cards, said method comprising the steps of:

(a) selecting a stud poker game;

(b) successively dealing said cards to build up a plurality of hands thereof, each of said hands having a wagering subset of said cards;

(c) prior to and during said dealing, at least one player sporadically wagering on selected ones of said hands;

(d) at least one of said hands having a winning combination of said cards in said wagering subsets after said dealing is complete; and (e) any of said wagers identifying said at least one of said hands constituting a winning wager.

2. The method of playing a game of claim 1 wherein all of said plurality of hands have the same number of said cards, said number being at least one.

3. The method of playing a game of claim 1 wherein said wagering subset includes all of said cards in said hand.

4. The method of playing a card game of claim 1 wherein said wagering subset is the same for all of said plurality of hands.

5. The method of playing a card game of claim 1 wherein said winning combination has the highest poker ranking of said hands.

6. The method of playing a card game of claim 1 wherein said winning combination has the lowest poker ranking of said hands.

7. The method of playing a card game of claim 1 wherein, prior to said dealing, said at least one player chooses whether said winning combination has the highest poker ranking of said hands or the lowest poker ranking of said hands.

8. The method of playing a card game of claim 1 wherein a round is when all of said hands receive an additional card during said successive dealing and said sporadic wagering occurs after each of said rounds is dealt.

9. The method of playing a card game of claim 1 wherein said sporadic wagering occurs only prior to said dealing.

10. The method of playing a card game of claim 1 wherein said player wagering said winning wager receives a multiple of said winning wager.

11. The method of playing a card game of claim 10 wherein said multiple depends upon the odds of obtaining the combination of said cards in said winning combination.

12. The method of playing a card game of claim 1 wherein, prior to said dealing, said at least one player wagers a vigorish.

13. The method of playing a card game of claim 1 wherein a match jackpot is provided, at least one jackpot player, prior to said dealing, wagering a match bet in said match jackpot, said at least one jackpot player winning a predetermined portion of said match jackpot if at least two of said hands have said winning combination.

14. The method of playing a card game of claim 1 wherein a tough beat jackpot is provided, at least one jackpot player, prior to said dealing, wagering a tough beat bet in said tough beat jackpot, a predetermined portion of said tough beat jackpot being won by said at least one jackpot player after said hands are dealt if each of at least two of said hands has a predetermined combination and one of said at least two of said hands is ranked higher than the remainder of said at least two of said hands.

15. A method of playing a card game with at least one standard deck of 52 playing cards, said method comprising the steps of:

(a) selecting a stud poker game;

(b) at least one player wagering on selected ones of said hands;

(c) successively dealing said cards to build up a plurality of hands thereof, all of said plurality of hands having the same number of said cards, said number being at least one;

(d) at least one of said hands having a winning combination of said cards after said dealing is complete;

(e) any of said wagers identifying said at least one of said hands constituting a winning wager; and (f) said player wagering said winning wager receiving a multiple of said winning wager.

16. The method of playing a card game of claim 15 wherein said multiple depends upon the odds of obtaining the combination of said cards in said winning combination.

17. The method of playing a card game of claim 15 wherein, prior to said dealing, said at least one player chooses whether said winning combination has the highest poker ranking of said hands or the lowest poker ranking of said hands.

18. The method of playing a card game of claim 15 wherein, prior to said dealing, said at least one player wagers a vigorish.

* * * * *